US009417564B2

(12) United States Patent
Ito et al.

(10) Patent No.: US 9,417,564 B2
(45) Date of Patent: Aug. 16, 2016

(54) IMAGE FORMING APPARATUS HAVING ROLLERS, BELT AND A TENSION APPLYING UNIT

(71) Applicant: Oki Data Corporation, Tokyo (JP)

(72) Inventors: Michiaki Ito, Tokyo (JP); Takayuki Takazawa, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/563,498

(22) Filed: Dec. 8, 2014

(65) Prior Publication Data

US 2015/0160588 A1 Jun. 11, 2015

(30) Foreign Application Priority Data

Dec. 10, 2013 (JP) ..... 2013-254890
Aug. 25, 2014 (JP) ..... 2014-170611

(51) Int. Cl.
*G03G 15/01* (2006.01)
*G03G 15/16* (2006.01)

(52) U.S. Cl.
CPC .. *G03G 15/1615* (2013.01); *G03G 2215/00156* (2013.01); *G03G 2215/0129* (2013.01)

(58) Field of Classification Search
CPC ..... G03G 15/1615; G03G 2215/00156; G03G 2215/0129
USPC ..... 399/302, 303
See application file for complete search history.

(56) References Cited

U.S. PATENT DOCUMENTS

2008/0199232 A1* 8/2008 Takemura ..... G03G 15/2053 399/329
2009/0084661 A1* 4/2009 Graswinckel ..... G03G 15/755 198/807
2014/0083821 A1* 3/2014 Hozumi ..... G03G 15/1615 198/806

FOREIGN PATENT DOCUMENTS

JP 2007140049 A * 6/2007
JP 2007-225969 A 9/2007

* cited by examiner

*Primary Examiner* — Walter L Lindsay, Jr.
*Assistant Examiner* — Ruth Labombard
(74) *Attorney, Agent, or Firm* — Rabin & Berdo, P.C.

(57) ABSTRACT

An image forming apparatus includes: a plurality of rollers including a first roller rotated by receiving rotation from a drive unit and a second roller rotated with the rotation of the first roller; a belt stretched around the plurality of rollers, the belt having an inner surface; and a tension applying unit that applies tension to the belt. The inner surface of the belt has an uneven shape. Each of at least one roller of the plurality of rollers satisfies conditions expressed by $\mu kmax \leq 0.73$ and $\Delta\mu k = (\mu kmax - \mu kmin) \leq 0.51$, where $\mu kmax$ is a maximum dynamic friction coefficient between the inner surface of the belt and the roller, and $\mu kmin$ is a minimum dynamic friction coefficient between the inner surface of the belt and the roller.

24 Claims, 8 Drawing Sheets

FIG. 9

| | 3.54 [ nm/s ] | | | 0.2 [ nm/s ] | | | EVALUATION |
|---|---|---|---|---|---|---|---|
| | μ kmax | μ kmin | Δ μ k | μ kmax | μ kmin | Δ μ k | |
| BELT #1 | 0.94 | 0.58 | 0.36 | 1.02 | 0.40 | 0.62 | Poor |
| BELT #2 | 0.66 | 0.40 | 0.26 | 0.84 | 0.28 | 0.56 | Poor |
| BELT #3 | 0.62 | 0.34 | 0.28 | 0.84 | 0.40 | 0.44 | Poor |
| BELT #4 | 0.58 | 0.28 | 0.30 | 0.79 | 0.28 | 0.51 | Poor |
| BELT #5 | 0.58 | 0.34 | 0.24 | 0.79 | 0.34 | 0.45 | Poor |
| BELT #6 | 0.54 | 0.31 | 0.23 | 0.73 | 0.22 | 0.51 | Fair |
| BELT #7 | 0.54 | 0.28 | 0.26 | 0.73 | 0.14 | 0.59 | Poor |
| BELT #8 | 0.50 | 0.28 | 0.22 | 0.73 | 0.28 | 0.45 | Good |
| BELT #9 | 0.36 | 0.24 | 0.12 | 0.42 | 0.28 | 0.14 | Good |
| BELT #10 | 0.14 | 0.10 | 0.04 | 0.18 | 0.14 | 0.04 | Good |
| BELT #11 | 0.10 | 0.07 | 0.03 | 0.12 | 0.08 | 0.04 | Good |
| BELT #12 | 0.05 | 0.04 | 0.01 | 0.06 | 0.03 | 0.03 | Good |

IMAGE FORMING APPARATUS HAVING ROLLERS, BELT AND A TENSION APPLYING UNIT

BACKGROUND OF THE INVENTION

1. Field of the Invention

The present invention relates to an image forming apparatus.

2. Description of the Related Art

In Japanese Patent Application Publication No. 2007-225969, Ito describes an electrophotographic color printer. This printer includes image forming units for four colors of black, yellow, magenta, and cyan. Each of the image forming units includes a photosensitive drum, a charging unit that charges the surface of the photosensitive drum, an exposure unit that illuminates the charged surface to form an electrostatic latent image, a developing unit that develops the electrostatic latent image with toner to form a toner image. The printer further includes an endless belt stretched around a drive roller and a tension roller, and transfer rollers disposed to face the respective photosensitive drums with the endless belt therebetween. As a sheet is conveyed by the endless belt, the toner images of the respective colors are sequentially transferred onto the sheet in a superposed manner by the transfer rollers, so that a color toner image is formed on the sheet. The color toner image is fixed to the sheet by a fixing unit.

However, in an image forming apparatus having a belt, an abnormal sound may occur when the belt runs.

SUMMARY OF THE INVENTION

An aspect of the present invention is intended to reduce the occurrence of abnormal sound when the belt runs.

According to an aspect of the present invention, there is provided an image forming apparatus including a plurality of rollers including a first roller rotated by receiving rotation from a drive unit and a second roller rotated with the rotation of the first roller; a belt stretched around the plurality of rollers, the belt having an inner surface; and a tension applying unit that applies tension to the belt. The inner surface of the belt has an uneven shape. Each of at least one roller of the plurality of rollers satisfies conditions expressed by $\mu kmax \leq 0.73$ and $\Delta\mu k=(\mu kmax-\mu kmin) \leq 0.51$, where $\mu kmax$ is a maximum dynamic friction coefficient between the inner surface of the belt and the roller, and $\mu kmin$ is a minimum dynamic friction coefficient between the inner surface of the belt and the roller.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 9 shows results of abnormal sound evaluations in the first embodiment;

DETAILED DESCRIPTION OF THE INVENTION

Embodiments of the invention will now be described with reference to the attached drawings. Each embodiment illustrates a printer as an image forming apparatus.

First Embodiment

Figure 1:
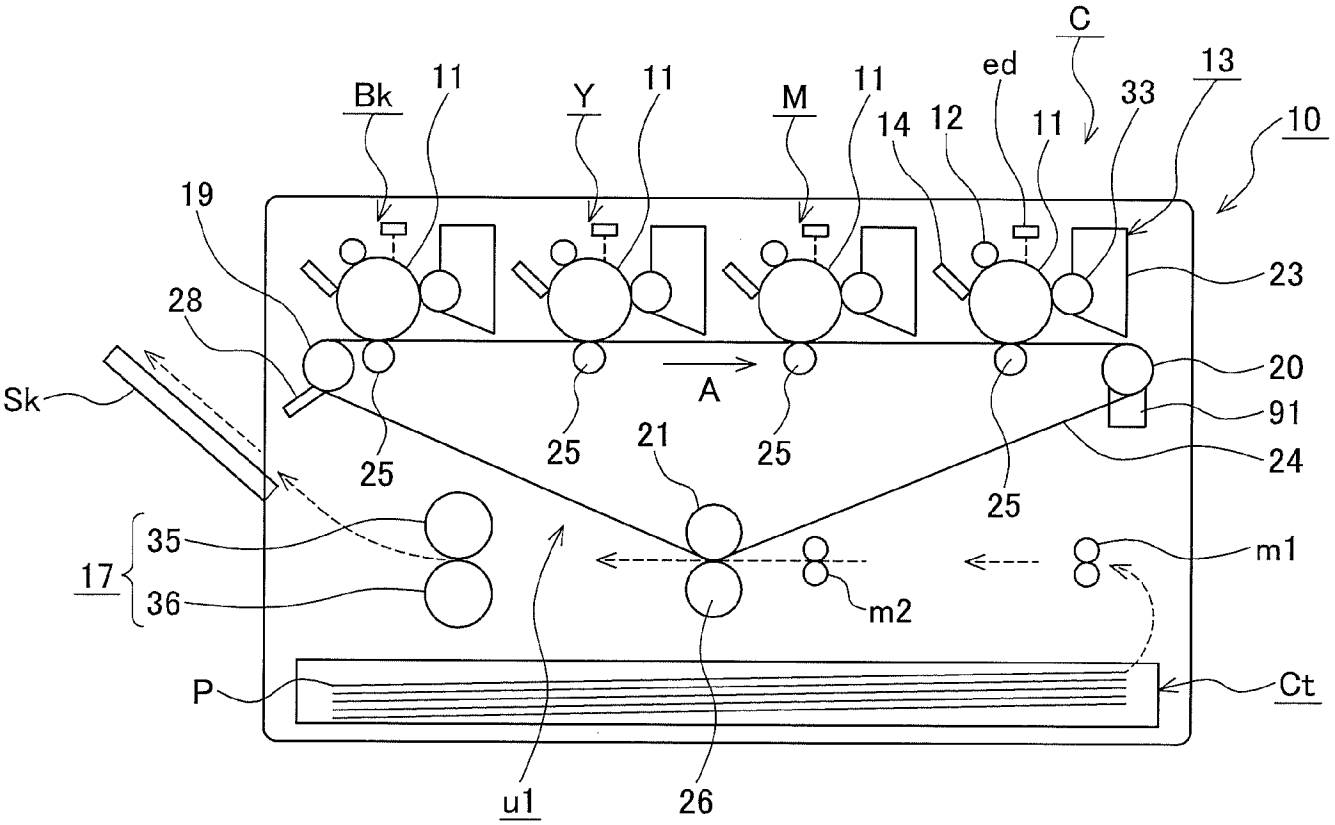
FIG. 1 is a schematic view of a printer in a first embodiment of the invention.
Figure 2:
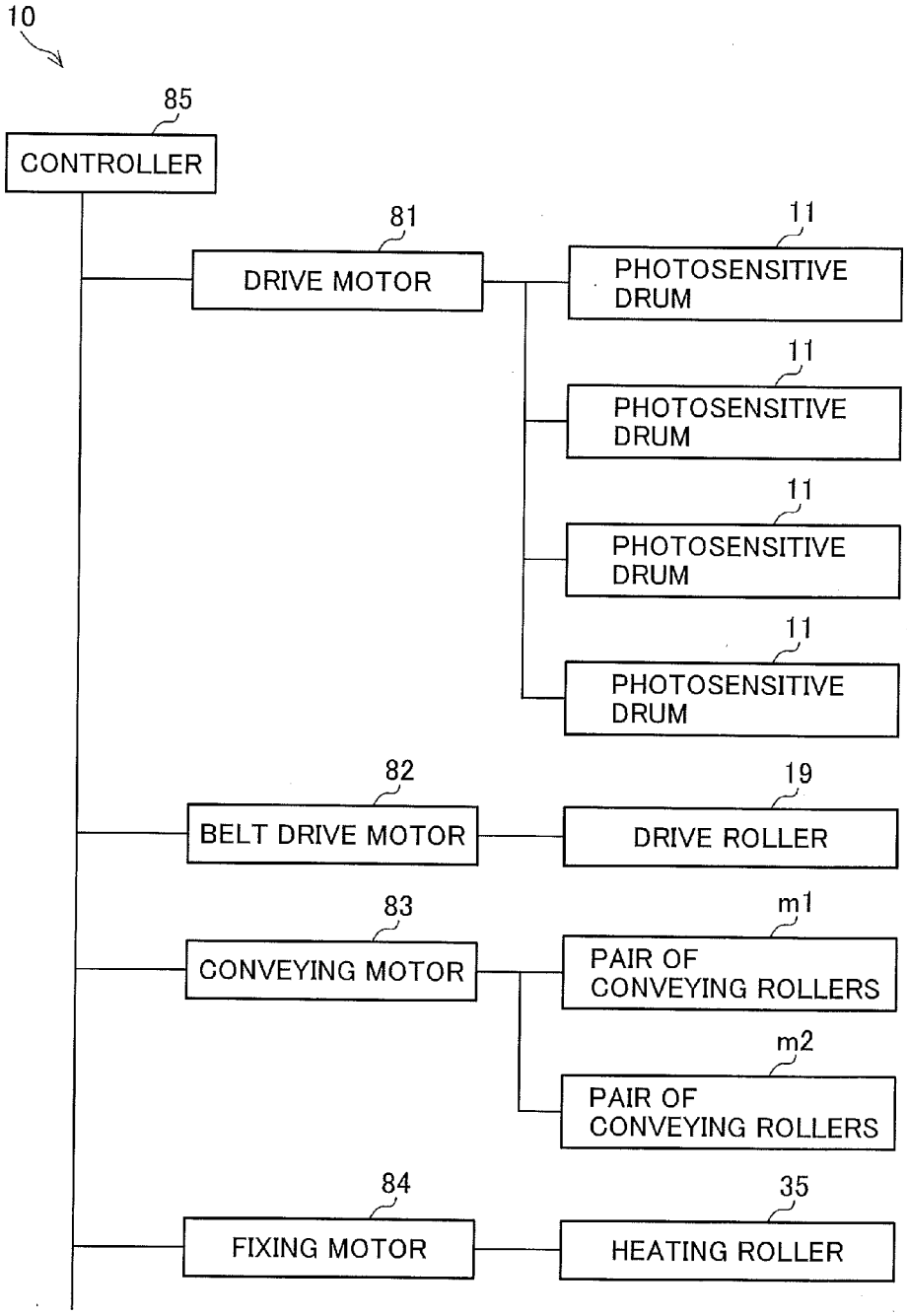
FIG. 2 is a block diagram of the printer in the first embodiment.

FIG. 1 is a schematic view showing a printer 10 in the first embodiment. FIG. 2 is a block diagram of the printer 10.

In FIG. 1, the printer 10 includes image forming units Bk, Y, M, and C for black, yellow, magenta, and cyan, and a sheet cassette Ct. Each of the image forming units Bk, Y, M and C includes a photosensitive drum 11 as an image carrier, a charging roller 12 as a charging device, an LED head (Light Emitting Diode) ed as an exposure device, a developing unit 13, a cleaning blade 14 as a first cleaning member, and other components. The photosensitive drum 11 is rotatably disposed and connected to a drive motor 81 as a drive unit for image formation. The charging roller 12 is rotatably disposed in contact with the photosensitive drum 11 and uniformly charges a surface of the photosensitive drum 11. The LED head ed is disposed to face the photosensitive drum 11 and illuminates the photosensitive drum 11 charged by the charging roller 12 to form an electrostatic latent image as a latent image. The developing unit 13 is disposed to face the photosensitive drum 11 and develops the electrostatic latent image formed on the surface of the photosensitive drum 11. The cleaning blade 14 is disposed in contact with the photosensitive drum 11 at its tip. The developing unit 13 includes a toner cartridge 23 as a developer container and a developing roller 33 as a developer carrier, and other components. The toner cartridge 23 stores toner as developer. The developing roller 33 is disposed in contact with the photosensitive drum 11, carries toner supplied from the toner cartridge 23, and supplies the toner to the electrostatic latent image to form a toner image as a developer image. The sheet cassette Ct serves as a sheet feeding unit and a medium storage unit, and stores sheets of paper P as media.

The printer 10 further includes a transfer unit u1 disposed below the image forming units Bk, Y, M, and C.

The transfer unit u1 includes a drive roller 19 as a first roller, a driven roller 20 as a second roller, a backup roller 21 as a third roller, an endless belt 24 as a transfer medium, transfer rollers (primary transfer rollers) 25 as first transfer members, a transfer roller (secondary transfer roller) 26 as a second transfer member, a cleaning blade 28 as a second cleaning member, and other components. The drive roller 19 is disposed near the image forming unit Bk, connected to a belt drive motor 82 as a drive unit for driving the belt 24 to run, and rotated by receiving rotation from the belt drive motor 82.

The driven roller 20 is disposed near the image forming unit C and rotated with the rotation of the drive roller 19. The backup roller 21 is disposed below the drive roller 19 and driven roller 20, and rotated with the rotation of the drive roller 19. The belt 24 is stretched around the drive roller 19, driven roller 20, and backup roller 21, and driven to run in the direction indicated by arrow A in FIG. 1 in accordance with the rotation of the drive roller 19. Each of the transfer rollers 25 is disposed to face the corresponding photosensitive drum 11 with the belt 24 therebetween. The transfer roller 26 is disposed to face the backup roller 21 with the belt 24 therebetween. The cleaning blade 28 is disposed to face the drive roller 19 with the belt 24 therebetween and in contact with the belt 24 at its tip.

Specifically, the belt 24 has an inner surface and an outer surface, and the drive roller 19, driven roller 20, and backup roller 21 are disposed in contact with the inner surface of the belt 24. The belt 24 is rotated or moved by the rotation of the drive roller 19 by friction between the drive roller 19 and the inner surface of the belt 24. The driven roller 20 is rotated by the movement of the belt 24 by friction between the driven roller 20 and the inner surface of the belt 24. The backup roller 21 is rotated by the movement of the belt 24 by friction between the backup roller 21 and the inner surface of the belt 24.

Each of the transfer rollers 25 forms a primary transfer portion together with the corresponding photosensitive drum 11 and the belt 24. As the belt 24 runs, toner images of the respective colors formed on the respective photosensitive drums 11 are transferred in a superposed manner onto the belt 24 at the primary transfer portions, so that a color toner image is formed. The transfer roller 26 forms a secondary transfer portion together with the backup roller 21 and belt 24. The color toner image formed on the belt 24 is transferred onto a sheet P fed from the sheet cassette Ct at the secondary transfer portion.

The printer 10 further includes pairs of conveying rollers m1 and m2, a fixing unit 17 as a fixing device, and a stacker Sk. Each of the pairs of conveying rollers m1 and m2 is connected to a conveying motor 83 as a drive unit for conveyance, is rotated by receiving rotation from the conveying motor 83, and conveys a sheet P fed from the sheet cassette Ct. The fixing unit 17 fixes, to the sheet P, the color toner image transferred on the sheet P to form a color image. The sheet P with the color image formed thereon is discharged from a main body (i.e., an apparatus main body) of the printer 10, and is stacked on the stacker Sk.

The fixing unit 17 includes a heating roller 35 as a first fixing roller, a pressure roller 36 as a second fixing roller, and other components. The heating roller 35 is rotatably disposed, connected to a fixing motor 84 as a drive unit for fixing, and rotated by receiving rotation from the fixing motor 84. The pressure roller 36 is rotatably disposed in contact with the heating roller 35 and rotated by receiving the rotation of the heating roller 35. A halogen lamp (not shown) is disposed as a heating body in the heating roller 35. The color toner image formed on the sheet P is heated by the heating roller 35 and pressured by the pressure roller 36, thereby being fixed to the sheet P.

The toner of each color is formed by an emulsion polymerization method using a styrene-acrylic copolymer as a main component, in which 9 parts by weight of paraffin wax is included. The toner has an average particle diameter of 7 μm and a sphericity of 0.95. The use of such a toner makes it possible to improve the reproducibility and resolution of dots developed by the developing unit 13 and the transfer efficiency of the transfer unit u1, and eliminates the need for a release agent in the fixing unit 17, thereby improving image quality.

The printer 10 further includes a controller 85 that controls respective parts, including the drive motor 81, belt drive motor 82, conveying motor 83, and fixing motor 84, in the printer 10 to control the operation of the printer 10.

The operation of the printer 10 will now be described.

In each of the image forming units Bk, Y, M, and C, the surface of the photosensitive drum 11 is uniformly charged by the charging roller 12. Then, the respective LED heads ed are supplied with image data of the respective colors and driven to illuminate the photosensitive drums 11, so that electrostatic latent images corresponding to the image data of the respective colors are formed on the surfaces of the respective photosensitive drums 11. Toners of the respective colors are applied to the electrostatic latent images by the respective developing units 13, so that toner images of the respective colors are formed.

In the transfer unit u1, as the drive roller 19 rotates and the belt 24 runs in the direction of arrow A, the toner images of the respective colors are sequentially transferred in a superposed manner onto the belt 24 by the respective transfer rollers 25, so that a color toner image is formed on the belt 24. In each of the image forming units Bk, Y, M, and C, the toner (i.e., residual toner) remaining on the photosensitive drum 11 after the transfer of the toner image onto the belt 24 by the transfer roller 25 is scraped off and removed by the cleaning blade 14, together with other foreign matter.

Meanwhile, a sheet P is taken from the sheet cassette Ct, conveyed by the pairs of conveying rollers m1 and m2, and fed between the backup roller 21 and the transfer roller 26. The color toner image on the belt 24 is transferred onto the fed sheet P by the transfer roller 26. The toner (i.e., residual toner) remaining on the belt 24 after the transfer of the color toner image onto the sheet P by the transfer roller 26 is scraped off and removed by the cleaning blade 28, together with other foreign matter.

The sheet P is conveyed to the fixing unit 17, in which the color toner image is fixed to the sheet P, so that a color image is formed on the sheet P. Then, the sheet P is discharged outside the apparatus main body to be stacked on the stacker Sk.

The transfer unit u1 will now be described.

Figure 3:
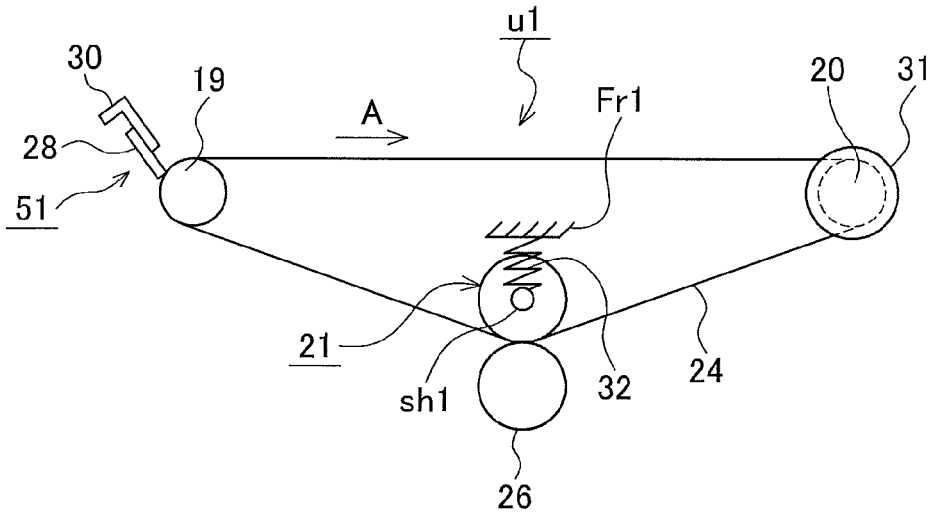
FIG. 3 shows a transfer unit in the first embodiment.
Figure 4:
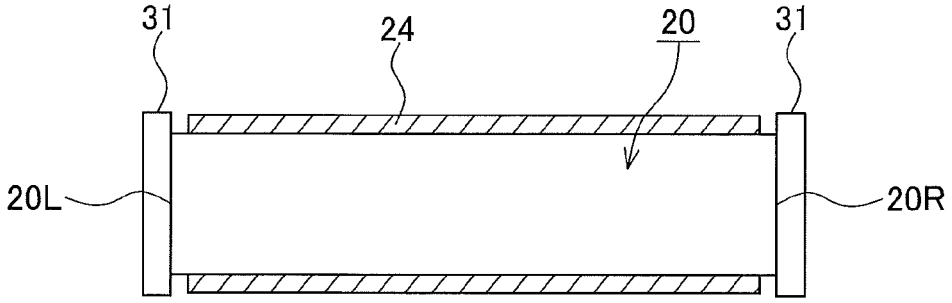
FIG. 4 shows a belt in a first state in the first embodiment.
Figure 5:
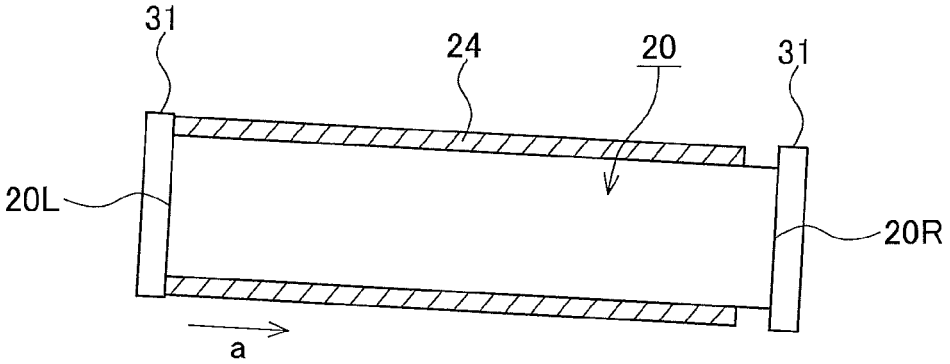
FIG. 5 shows the belt in a second state in the first embodiment.
Figure 6:
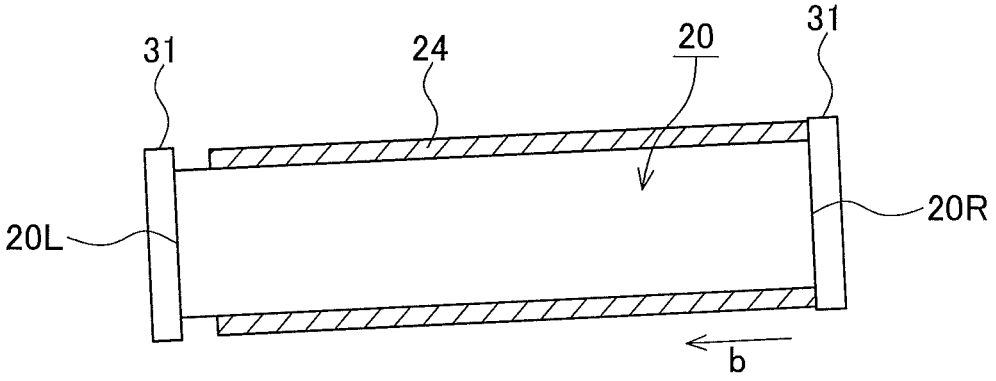
FIG. 6 shows the belt in a third state in the first embodiment.

FIG. 3 shows the transfer unit u1 in the first embodiment; FIG. 4 shows the belt 24 in a first state in the first embodiment; FIG. 5 shows the belt 24 in a second state in the first embodiment; FIG. 6 shows the belt 24 in a third state in the first embodiment.

Referring to FIGS. 3 to 6, the transfer unit u1 further includes a support member 30 that supports the cleaning blade 28, flanges 31 as restriction members (or guide members), and a spring 32 that serves as a tension applying unit, a stretching device, or a urging member and applies tension to the belt 24. The cleaning blade 28 and support member 30 constitute a cleaning device 51.

Each of the drive roller 19, driven roller 20, and backup roller 21 has a cylindrical body with an outer diameter of 25 mm and a surface in contact with the belt 24, the surface being made of a urethane material. The outer diameter of each of the drive roller 19, driven roller 20, and backup roller 21 may be 10 mm or more and 50 mm or less. The surface in contact with the belt 24 may be made of a metal material such as stainless steel (SUS) or aluminum, a resin material such as polyacetal or acrylonitrile-butadiene-styrene (ABS) resin, or a rubber material such as acrylonitrile butadiene rubber (NBR) or ethylene-propylene-diene rubber (EPDM).

The method of manufacturing the belt 24 will now be described.

Polyamide-imide (PAI) and carbon black are mixed and stirred in a solution with N-methylpyrrolidone (NMP) or the like as a solvent (organic polar solvent) to form a mixed solution. Then, the mixed solution is poured into a cylindrical mold, is heated for a predetermined period of time at a temperature of 80° C. or more and 120° C. or less while the mold is rotated, and then is further heated for a predetermined period of time at a temperature of 200° C. or more and 350° C. or less, so that a belt original tube with a thickness of 100±10 μm and a circumferential length of 1210.5±1.5 mm is formed in the mold. The belt original tube is taken out from the mold and cut into widths of 350±0.5 mm, each constituting one belt 24 having a structure consisting of one layer, that is, a single layer structure.

To form the belt original tube, instead of pouring the mixed solution into a cylindrical mold and rotating the mold, it is also possible to pour the mixed solution into a gap between two cylinders with different diameters, to rotate a cylindrical mold and apply the mixed solution to the peripheral surface of the mold, or to dip a cylindrical mold into the mixed solution. The belt original tube may be formed by extrusion molding, inflation molding, or other methods. No mixed solution is used in the extrusion molding and inflation molding.

After the belt 24 is formed, an uneven shape is formed on the inner surface of the belt 24 by an abrasive such as a variety of lapping films, which may be formed by coating a polymer film of polyester or the like with fine particles of alumina, chromic oxide, silicon carbide, or the like. As the lapping film, this embodiment uses 'finishing paper' (manufactured by Sumitomo 3M Ltd.) coated with particles (abrasive grains) of alumina of 5 μm, 9 μm, 30 μm, etc.

The polyamide-imide is a polymeric resin material having repeating units in which an amide group is bonded to one or two imide groups through an organic group. Polyamide-imides are classified as an aliphatic polyamide-imide or an aromatic polyamide-imide depending on whether the organic group is aliphatic or aromatic. This embodiment uses an aromatic polyamide-imide in which the organic group has one or two benzene rings.

The use of the aromatic polyamide-imide makes it possible to prevent edge portions of the belt 24 from wearing, bending, or cracking due to sliding contact of the belt 24 with the flanges 31, thereby improving the durability of the belt 24. Further, since tension occurs when the belt 24 runs, it is possible to prevent the belt 24 from deforming, thereby improving the mechanical properties of the belt 24.

The polyamide-imide may be one in which the imide ring closure is completed or one containing amide acids before the imide ring closure. The use of a polyamide-imide with a low imidization rate containing amide acids leads to a high rate of dimensional change of the belt 24. Thus, this embodiment uses a polyamide-imide having an imidization rate of 50% or more, preferably 70% or more.

The imidization rate is calculated based on a ratio between the intensity of the absorption at 1780 $cm^{-1}$ due to imide groups and the intensity of the absorption at 1510 $cm^{-1}$ due to benzene rings, by using a Fourier transform infrared spectrophotometer (referred to below as 'FT-IR').

In general, the use of a material having a molecular structure rich in aromatic rings, such as benzene rings, and imide groups makes it possible to increase the Young's modulus of the belt 24 and improve the durability and mechanical properties of the belt 24.

Thus, as the material of the belt 24, materials having high Young's moduli may be used separately or in combination (in a mixed manner). Such materials include resins of polyimide (PI), polycarbonate (PC), polyamide (PA), polyether ether ketone (PEEK), polyvinylidene fluoride (PVDF), and ethylene-tetrafluoroethylene copolymer (ETFE), which have, like polyamide-imide, Young's moduli of 3.0 GPa or more.

This embodiment uses the N-methylpyrrolidone as the solvent for mixing and stirring the polyamide-imide and carbon black, but besides the N-methylpyrrolidone, the following may be used: N,N-dimethylacetamides such as N,N-dimethylformamide, N,N-dimethylacetamide, N,N-diethylformamide, N,N-diethylacetamide, and dimethylsulfoxide, pyridine, tetramethylenesulfone, dimethyltetramethylenesulfone, etc. These solvents may be used separately or in combination.

In view of the thickness, thickness profile, or other properties of the belt 24, the rotation speed of the mold during formation of the belt original tube is set at 5 rpm or higher and 1000 rpm or lower, and preferably 10 rpm or higher and 500 rpm or lower. When the belt original tube is formed by rotating a cylindrical mold and applying the mixed solution to the peripheral surface of the mold, the rotation speed of the mold is set at 5 rpm or higher and 1000 rpm or lower, and preferably 10 rpm or higher and 500 rpm or lower.

There are many types of carbon black, such as furnace black, channel black, kitchen black, acetylene black. These types may be used separately or in combination. The type of carbon black may be selected according to the electrical conductivity required for the belt 24. It is preferable to use carbon black subjected to a treatment, such as an oxidation treatment or a graft treatment, for preventing oxidation degradation or improving the dispersibility in the solvent.

The content of the carbon black in the belt 24 is determined depending on the mechanical strength required for the belt 24 or other factors. The weight ratio of the carbon black to the polyamide-imide is set at 3% or more and 40% or less, preferably 5% or more and 30% or less, and more preferably 5% or more and 25% or less.

Although this embodiment uses a lapping film to form the uneven shape on the inner surface of the belt 24, the uneven shape may be formed by other methods. For example, when the belt original tube is formed by rotating a cylindrical mold, the uneven shape may be formed during the formation of the belt original tube, by appropriately setting the molding conditions, without using a lapping film.

When the belt original tube is formed by rotating a cylindrical mold and applying a mixed solution to the peripheral surface of the mold or by dipping a cylindrical mold into a mixed solution, machining marks may be formed, as the uneven shape, on the inner surface of the belt 24 by concavities and convexities on the peripheral surface of the mold. When the belt original tube is formed by extrusion molding, inflation molding, or the like, machining marks may be formed, as the uneven shape, by concavities and convexities of the nozzle of the extrusion apparatus. The uneven shape may be formed on the inner surface of the belt 24 by using a mold with a surface subjected to blast processing.

The uneven shape is an irregular uneven shape in this embodiment, but may be a regular uneven shape. In one preferred aspect, the uneven shape is formed in parallel with the direction (referred to below as the running direction) in which the belt 24 runs.

In order to improve the surface slidability of the belt 24, the mixed solution is added with a proper amount of water repellent agent, such as fluorine or silicone resin, so that the surface of the belt 24 has, with respect to stainless steel, a static friction coefficient lie of 0.1 or more and 1.0 or less.

If the static friction coefficient lie of the surface of the belt 24 is less than 0.1, the friction force occurring between the tip of the cleaning blade 28 and the belt 24 is insufficient to adequately scrape off the residual toner, foreign matter, and the like. On the other hand, if the static friction coefficient μe of the surface of the belt 24 is greater than 1.0, the friction force occurring between the tip of the cleaning blade 28 and the belt 24 is so large that an abnormal sound may occur between the tip of the cleaning blade 28 and the belt 24 or turning-up of the cleaning blade 28 may occur.

If an excessive amount of water repellent agent is added to the resin material, as the printer 10 is used over a long period of time, the water repellent agent is likely to bleed out on the surface of the belt 24. When the bled water repellent agent, i.e., the bled substance, adheres to the photosensitive drums 11, it becomes impossible to form toner images accurately, resulting in degradation of image quality.

In this embodiment, the static friction coefficient μe is measured by using a portable friction meter Muse Type:94i-II (manufactured by Heidon).

In order to adequately scrape off the residual toner, foreign matter, or the like on the belt 24, the surface of the belt 24 is roughened to have a specularity SPOT of 60 or more and 200 or less (in this embodiment, 120±10). The inner surface of the mold for forming the belt original tube is subjected to a predetermined surface treatment so as to give a predetermined specularity SPOT to the surface of the belt 24. When the belt original tube is formed without using a mold, the surface of the belt original tube is provided with a predetermined specularity SPOT by means of an abrasive such as a variety of lapping films.

If the specularity SPOT is less than 60, as the printer 10 is used for a long period of time, the residual toner, foreign matter, and the like cannot be scraped off adequately and may pass between the tip of the cleaning blade 28 and the belt 24.

If the specularity SPOT is greater than 200, the tip of the cleaning blade 28 and the belt 24 make a large contact area and produce a large friction force, so that turning-up of the cleaning blade 28 may occur.

In this embodiment, the specularity SPOT measured by a specularity measurement device Mirror SPOT AHS-100S (manufactured by Archarima Co., Ltd.).

The cleaning device 51 will now be described. In the cleaning device 51, the cleaning blade 28 is an elastic body made of a rubber material. In this embodiment, the cleaning blade 28 is formed of a urethane rubber blade having a hardness according to Japanese Industrial Standards (JIS) A of 72° and a thickness of 1.5 mm, and disposed so that its tip abuts against the belt 24 at a line pressure of 4.3 g/mm. Since urethane rubber has not only high hardness and elasticity but also superior abrasion resistance, mechanical strength, oil resistance, ozone resistance, and other properties, it allows the cleaning blade 28 not only to remove the residual toner, foreign matter, and the like certainly but also to have high durability.

Although this embodiment uses, as the cleaning blade 28, a urethane rubber blade having a hardness (JIS A) of 72°, it is also possible to use a urethane rubber blade having a hardness (JIS A) of 60° or more and 90° or less, and preferably 70° or more and 85° or less.

Further, this embodiment uses urethane rubber having a breaking elongation of 250% or more and 500% or less, preferably 300% or more and 400% or less, a permanent elongation of 1.0% or more and 5.0% or less, preferably 1.0% or more and 2.0% or less, and a rebound resilience of 10% or more and 70% or less, preferably 30% or more and 50% or less. Each of these properties can be measured according to JIS K6301 (modified JIS K6251).

Further, although the line pressure of the cleaning blade 28 is set at 4.3 g/mm in this embodiment, it may be set at 1 g/mm or more and 6 g/mm or less, and preferably 2 g/mm or more and 5 g/mm or less.

If the line pressure is too low, the cleaning blade 28 does not contact the belt 24 adequately, causing cleaning failure. On the other hand, if the line pressure is too high, the cleaning blade 28 makes surface contact with the belt 24, causes excessively large frictional resistance, and presses the belt 24 with a pressing force larger than the force required to scrape off residual toner, causing cleaning failure such as the so-called filming phenomenon or turning-up of the cleaning blade 28. In this embodiment, since the line pressure of the cleaning blade 28 is set at a proper value, the cleaning failure and turning-up of the cleaning blade 28 can be prevented from occurring.

The flanges 31 are attached to the both ends of a predetermined roller (in this embodiment, the driven roller 20) of the drive roller 19, driven roller 20, and backup roller 21. Specifically, when viewed from the running direction of the belt 24, the flanges 31 are attached to a left end 20L and a right end 20R of the driven roller 20. Each of the flanges 31 has a circular shape and satisfies $$df > dr + tb$$

where df is the outer diameter of the flange 31, dr is the outer diameter of the driven roller 20, and tb is the thickness of the belt 24.

When the belt 24 runs in accordance with the rotation of the drive roller 19, it may approach either of the left end 20L or the right end 20R of the driven roller 20 to contact one of the flanges 31. Thus, in this embodiment, the driven roller 20 is provided with an elevating mechanism 91 as an inclination mechanism. The elevating mechanism 91 is configured to incline the driven roller 20 so as to return the belt 24 to the position shown in FIG. 4. Specifically, when the belt 24 approaches the left end 20L and comes into contact with the left flange 31 as shown in FIG. 5, the elevating mechanism 91 is driven to move the left end 20L upward, so that the driven roller 20 is slightly inclined. Thereby, the belt 24 moves on the driven roller 20 in the direction of arrow a and returns to the position shown in FIG. 4.

When the belt 24 approaches the right end 20R and comes into contact with the right flange 31 as shown in FIG. 6, the elevating mechanism 91 is driven to move the left end 20L downward, so that the driven roller 20 is slightly inclined. Thereby, the belt 24 moves on the driven roller 20 in the direction of arrow b and returns to the position shown in FIG. 4.

When the belt 24 moves to the left end 20L side, the left flange 31 abuts against the left edge of the belt 24 to restrict the belt 24 from further moving leftward; when the belt 24 moves to the right end 20R side, the right flange 31 abuts against the right edge of the belt 24 to restrict the belt 24 from further moving rightward. Thus, belt 24 can be prevented from meandering.

Although the elevating mechanism 91 lifts and lowers the left end 20L of the driven roller 20 in this embodiment, it may lift and lower the right end 20R of the driven roller 20. Further, although the flanges 31 are disposed at both of the left end 20L and right end 20R of the driven roller 20 in this embodiment, such flanges may be disposed at only one end (e.g., right end 20R) of the driven roller 20. In this case, the driven roller 20 is slightly inclined in advance in such a manner that the left end 20L is above the right end 20R so that the belt 24 is biased toward the right end 20R and abuts against the flange 31.

Although the flanges 31 are attached to the driven roller 20 in this embodiment, such flanges may be attached to the drive roller 19 or backup roller 21, or to two or more of the drive roller 19, driven roller 20, and backup roller 21. Further, although the flanges 31 are attached to the both ends of the driven roller 20 in this embodiment, such flanges may be attached to only one end of a predetermined roller. Further, although the flanges 31 are disposed as guide members in this embodiment, it is possible to dispose a belt support device that supports the belt 24 during running of the belt 24 at a predetermined position and provide, as a guide member, a piece for restricting movement of the belt 24 to the belt support device.

The spring 32 is disposed between a support member Fr1 provided in the apparatus main body and a shaft sh1 of the backup roller 21 to urge the backup roller 21 toward the transfer roller 26 with a stretching force of 6±10% kg=6±(6×0.1) kg.

Although the stretching force is 6±10% kg in this embodiment, it may be set appropriately depending on the material of the belt 24, the torque generated by the belt drive motor 82, or other factors, and may be set to 2±10% kg or more and 8±10% kg or less.

Although the spring 32 is used as a tension applying unit in this embodiment, a pneumatic piston or the like may be used.

The above printer 10 causes the belt 24 to run so as to form an image. Depending on the condition of the inner surface of the belt 24, when the belt 24 runs, it may move in an axial direction (referred to below as the roller axial direction) in which the drive roller 19, driven roller 20, and backup roller 21 extend, and generate an abnormal sound. In particular, when the elevating mechanism 91, which is for preventing the belt 24 from meandering, is driven to move the belt 24 on the driven roller 20, an abnormal sound is likely to occur.

In general, when the inner surface of the belt 24 and the surface of each of the drive roller 19, driven roller 20, and backup roller 21 are smooth, an abnormal sound, such as a chattering sound, a high-frequency frictional sound (squeak) is likely to occur at positions at which the belt 24 is in contact with the rollers. This is thought to be because a vibration phenomenon called chattering, i.e., a stick-slip phenomenon, occurs between the belt 24 and the rollers.

Specifically, in a state where the belt 24 is in intimate contact with the rollers, when an external force is applied to the belt 24 in the roller axial direction, the contact surfaces of the belt 24 with the rollers receive friction forces. If the external force is insufficient, the belt 24 does not move in the roller axial direction due to the friction forces. When a further external force is applied to the belt 24 and the internal stress in the belt 24 becomes larger than a predetermined value, the belt 24 momentarily slides on the rollers, is released from the external force, and comes again into intimate contact with the rollers at the position at which the sliding ends. The repetition of this action causes a stick-slip phenomenon and vibrates the belt 24, causing an abnormal sound.

The smoother the inner surface of the belt 24 and the surfaces of the rollers are, the larger the contact area between the belt 24 and the rollers is, the larger the friction forces exerted on the contact surfaces are, and the more the stick-slip phenomenon is likely to occur.

Further, the lower the speed at which the belt 24 runs (i.e., a belt linear speed) is, the more the stick-slip phenomenon is likely to occur. Even if the belt linear speed during image formation is high, when the belt 24 is accelerated to start running or when the belt 24 is decelerated to stop running, the stick-slip phenomenon is likely to occur. Thus, the abnormal sound is likely to occur when the belt 24 moves at low speed relative to the rollers (e.g., when the belt 24 moves in the roller axial direction, or when the belt 24 moves in the running direction at low speed during acceleration or deceleration).

Next, the relationship between a dynamic friction coefficient μk and abnormal sound occurring when the belt 24 runs will be described. The dynamic friction coefficient μk represents a friction coefficient between the inner surface of the belt 24 and the peripheral surface of a roller (the drive roller 19, driven roller 20, or backup roller 21) in contact with the belt 24 when the belt 24 runs.

The method of measuring the dynamic friction coefficient μk will be described first.

Figure 7:
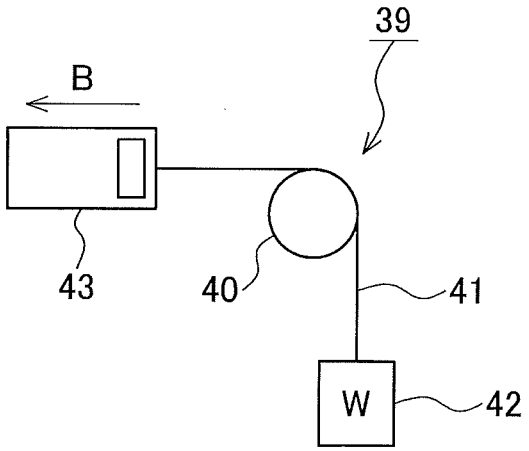
FIG. 7 is a schematic view of a measurement device for measuring a dynamic friction coefficient based on the Euler's belt theory in the first embodiment.

FIG. 7 is a schematic view showing a measurement device 39 for measuring the dynamic friction coefficient based on the Euler's belt theory.

In FIG. 7, the measurement device 39 includes a pulley 40, a belt 41, a weight 42, and a load cell 43. The pulley 40 has the same dimensions as and is made of the same material as the drive roller 19, driven roller 20, and backup roller 21. The pulley 40 is unrotatably attached to a frame or other parts of the measurement device 39. The belt 41 is made of the same material as and by the same method as the belt 24. The belt 41 is wound around a part of the pulley 40 over an angle of 90° (π/2 rad). The weight 42 is attached to one end of the belt 41. As the load cell 43, a digital force gauge ZP-50N (manufactured by IMADA Co., Ltd.) is used.

The weight W of the weight 42 is 320 gf. The width of the belt 41 is 25 mm. In an environment having an ambient temperature of 23±3° C. and a relative humidity of 55±10%, the force F required to move the load cell 43 at a constant speed in the direction of arrow B is measured by the load cell 43, and the dynamic friction coefficient μk is obtained according to the Euler's belt formula:

$$\mu k=(2/\pi)\times\ln(F/W).$$

Hereinafter, the speed at which the load cell 43 moves during the measurement (i.e., the above constant speed) will be referred to as the cell speed.

Figure 8:
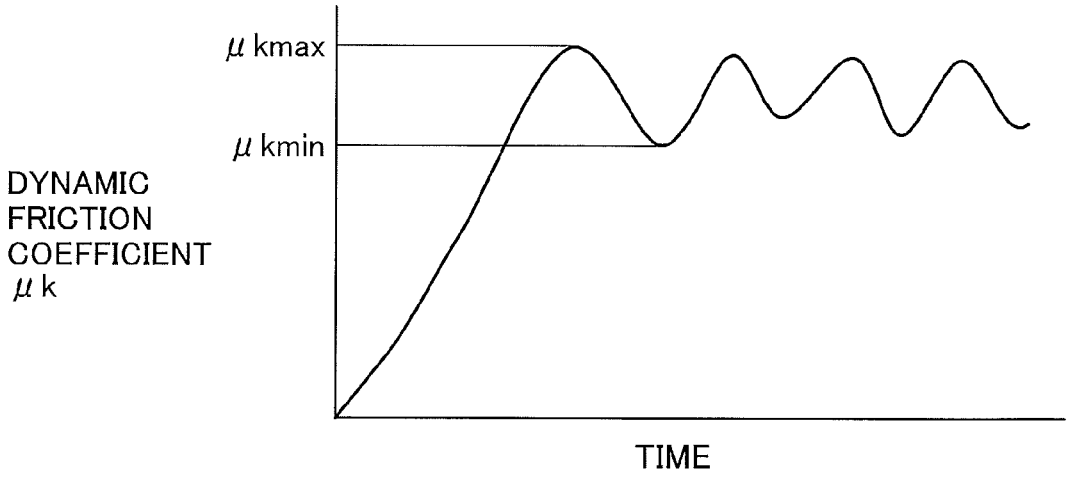
FIG. 8 shows an example of a temporal variation of the dynamic friction coefficient in the first embodiment.

From the above measurement, a temporal variation of the dynamic friction coefficient μk is obtained. FIG. 8 shows an example of the temporal variation of the dynamic friction coefficient. In FIG. 8, the horizontal axis represents the time and the vertical axis represents the dynamic friction coefficient μk. In the measurement by the measurement device 39, when the load cell 43 moves, a stick-slip phenomenon occurs between the belt 41 (corresponding to the belt 24) and the pulley 40 (corresponding to the drive roller 19, driven roller 20, or backup roller 21), and the dynamic friction coefficient μk varies as shown in FIG. 8.

From the temporal variation of the dynamic friction coefficient μk, a maximum value of the dynamic friction coefficient μk (i.e., a maximum dynamic friction coefficient μkmax), a minimum value of the dynamic friction coefficient μk (i.e., a minimum dynamic friction coefficient μkmin), and an amplitude Δμk represented by the difference between the maximum dynamic friction coefficient μkmax and the minimum dynamic friction coefficient μkmin are obtained as follows. The largest of local maximum values of the dynamic friction coefficient μk is determined to be the maximum dynamic friction coefficient μkmax; the smallest of local minimum values of the dynamic friction coefficient μk is determined to be the minimum dynamic friction coefficient μkmin; the difference between the maximum dynamic friction coefficient μkmax and the minimum dynamic friction coefficient μkmin is determined to be the amplitude Δμk, according to the equation: Δμk=μkmax−μkmin.

Next, a method of obtaining the relationship between the dynamic friction coefficient μk and abnormal sound occurring when the belt runs will be described.

Twelve types of belt samples #1 to #12 with different irregular uneven shapes on their inner surfaces were manufactured. Each of the samples #1 to #12 was individually mounted as the belt 41 in the measurement device 39 and its maximum dynamic friction coefficient μkmax, minimum dynamic friction coefficient μkmin, and amplitude Δμk were obtained according to the above method.

For each sample, the measurement was carried out at each of the following cell speeds: 3.54 mm/s and 0.2 mm/s. Thus, for each of the samples #1 to #12, at each of the two cell speeds, the maximum dynamic friction coefficient μkmax, the minimum dynamic friction coefficient μkmin, and the amplitude Δμk were obtained. The two cell speeds were determined in view of the speed of movement of the belt in the roller axial direction in the printer 10.

Twelve types of belts #1 to #12 were also manufactured so as to have the same uneven shapes and dynamic friction coefficients as the samples #1 to #12, respectively. The belt #12 had its inner surface applied with zinc stearate so as to have high slidability, and thus the dynamic friction coefficient μk between the belt #12 and each roller is significantly small. For each of the belts #1 to #12, an abnormal sound evaluation was carried out as follows. The belt to be evaluated was actually mounted as the belt 24 in a printer having the configuration shown in FIG. 1 and is driven to run. At this time, it was determined whether an abnormal sound occurred.

The results of the measurements and abnormal sound evaluations will now be described.

FIG. 9 shows the results of the measurements and abnormal sound evaluations in the first embodiment.

FIG. 9 lists the maximum dynamic friction coefficient μkmax, the minimum dynamic friction coefficient μkmin, and the amplitude Auk at each of the cell speeds of 3.54 mm/s and 0.2 mm/s, and the result of the abnormal sound evaluation, for each of the belts #1 to #12. FIG. 9 uses the maximum dynamic friction coefficients μkmax, minimum dynamic friction coefficients μkmin, and amplitudes Δμk of the samples #1 to #12 as those of the belts #1 to #12, respectively.

In the results of the abnormal sound evaluations, the word Good indicates that no abnormal sound occurred, the word Fair indicates that a slight abnormal sound with no practical problems in the printer 10 occurred, and the word Poor indicates that an abnormal sound with practical problems in the printer 10 occurred.

As can be seen from the results for the belts #1 to #11 in FIG. 9, the occurrence of abnormal sound due to running of the belt 24 is reduced when the following conditions are satisfied: the maximum dynamic friction coefficient μkmax is 0.73 or less and 0.10 or more, and the amplitude Δμk is 0.51 or less (preferably 0.45 or less).

The occurrence of abnormal sound due to running of the belt 24 is reduced when the following conditions are satisfied: the maximum dynamic friction coefficient μkmax is 0.73 or less and 0.12 or more, and the amplitude Δμk is 0.51 or less (preferably 0.45 or less) when the speed of the belt 24 is 0.2 mm/s.

The occurrence of abnormal sound due to running of the belt 24 is reduced when the following conditions are satisfied: the maximum dynamic friction coefficient μkmax is 0.54 or less and 0.10 or more, and the amplitude Δμk is 0.23 or less (preferably 0.22 or less) when the speed of the belt 24 is 3.54 mm/s.

For the belt #12, no abnormal sound occurred, but color shift occurred in an image formed using the belt #12. This is thought to be because slippage occurred between the inner surface of the belt 24 and the drive roller 19 since the dynamic friction coefficient μk between the belt 24 and the drive roller 19 was small. Thus, from the results for the belts #1 to #12, the occurrence of abnormal sound due to running of the belt 24 is reduced when the following conditions are satisfied: the maximum dynamic friction coefficient μkmax is 0.73 or less and 0.05 or more, and the amplitude Δμk is 0.51 or less (preferably 0.45 or less). Further, the occurrence of abnormal sound due to running of the belt 24 is reduced and the occurrence of color shift in the image is prevented when the following conditions are satisfied: the maximum dynamic friction coefficient μkmax is 0.73 or less and 0.10 or more, and the amplitude Δμk is 0.51 or less (preferably 0.45 or less).

The occurrence of abnormal sound due to running of the belt 24 is reduced when the following conditions are satisfied: the maximum dynamic friction coefficient μkmax is 0.73 or less and 0.06 or more, and the amplitude Δμk is 0.51 or less (preferably 0.45 or less) when the speed of the belt 24 is 0.2 mm/s. Further, the occurrence of abnormal sound due to running of the belt 24 is reduced and the occurrence of color shift in the image is prevented when the following conditions are satisfied: the maximum dynamic friction coefficient μkmax is 0.73 or less and 0.12 or more, and the amplitude Δμk is 0.51 or less (preferably 0.45 or less) when the speed of the belt 24 is 0.2 mm/s.

The occurrence of abnormal sound due to running of the belt 24 is reduced when the following conditions are satisfied: the maximum dynamic friction coefficient μkmax is 0.54 or less and 0.05 or more, and the amplitude Δμk is 0.23 or less (preferably 0.22 or less) when the speed of the belt 24 is 3.54 mm/s. Further, the occurrence of abnormal sound due to running of the belt 24 is reduced and the occurrence of color shift in the image is prevented when the following conditions are satisfied: the maximum dynamic friction coefficient μkmax is 0.54 or less and 0.10 or more, and the amplitude Δμk is 0.51 or less (preferably 0.45 or less) when the speed of the belt 24 is 3.54 mm/s.

The amplitude Δμk has no lower limit and can be equal to zero in principle.

Since the minimum dynamic friction coefficient μkmin is smaller than the maximum dynamic friction coefficient μkmax, the smaller the maximum dynamic friction coefficient μkmax is, the smaller the amplitude Δμk is.

As above, in this embodiment, an uneven shape is provided on the inner surface of the belt 24. This reduces the contact area between the surfaces of the rollers and the inner surface of the belt 24, and reduces electrostatic attractive force occurring between the rollers and the belt 24, thereby lowering the maximum dynamic friction coefficient μkmax of the belt 24. Further, the amplitude Δμk can be reduced. Thus, the occurrence of the stick-slip phenomenon can be reduced, and the occurrence of abnormal sound can be reduced.

Specifically, the belt 24 is configured to satisfy, with respect to each of the three rollers (the drive roller 19, driven roller 20, and backup roller 21) in contact with the inner surface of the belt 24, the following conditions: the maximum dynamic friction coefficient μkmax is 0.73 or less and 0.10 or more, and the amplitude Δμk is 0.51 or less (preferably 0.45 or less). This reduces the occurrence of abnormal sound due to running of the belt 24.

More specifically, the belt 24 is configured to satisfy, with respect to each of the three rollers, the following conditions: the maximum dynamic friction coefficient μkmax is 0.73 or less and 0.12 or more, and the amplitude Δμk is 0.51 or less (preferably 0.45 or less) when the speed of the belt 24 is 0.2 mm/s. In addition or alternatively, the belt 24 is configured to satisfy, with respect to each of the three rollers, the following conditions: the maximum dynamic friction coefficient μkmax is 0.54 or less and 0.10 or more, and the amplitude Δμk is 0.23 or less (preferably 0.22 or less) when the speed of the belt 24 is 3.54 mm/s. These reduce the occurrence of abnormal sound due to running of the belt 24.

Further, in this embodiment, since an uneven shape is provided on the inner surface of the belt 24, the surfaces of the rollers need neither be roughened nor undergo friction reducing treatment. Thus, the drive roller 19 can ensure the force for driving the belt 24 to run and drive the belt 24 to run stably without slippage of the belt 24. In addition, if uneven shapes are formed on the surfaces of the rollers, they may affect the surface of the belt 24 and cause cleaning failure at the cleaning blade 28. However, this embodiment can eliminate such a problem since no uneven shapes need to be formed on the surfaces of the rollers. Further, since there is no need to perform, on the inner surface of the belt 24, a friction reducing treatment other than the formation of the uneven shape, it is possible to reduce the cost of the belt 24 and form the belt 24 easily.

Second Embodiment

A second embodiment will now be described. Descriptions of parts that are the same as in the first embodiment will be omitted or simplified in the description below, and the same reference characters will be used for elements that are the same as or correspond to those in the first embodiment. Parts that are the same as in the first embodiment provide the same advantages in the first embodiment.

Figure 10:
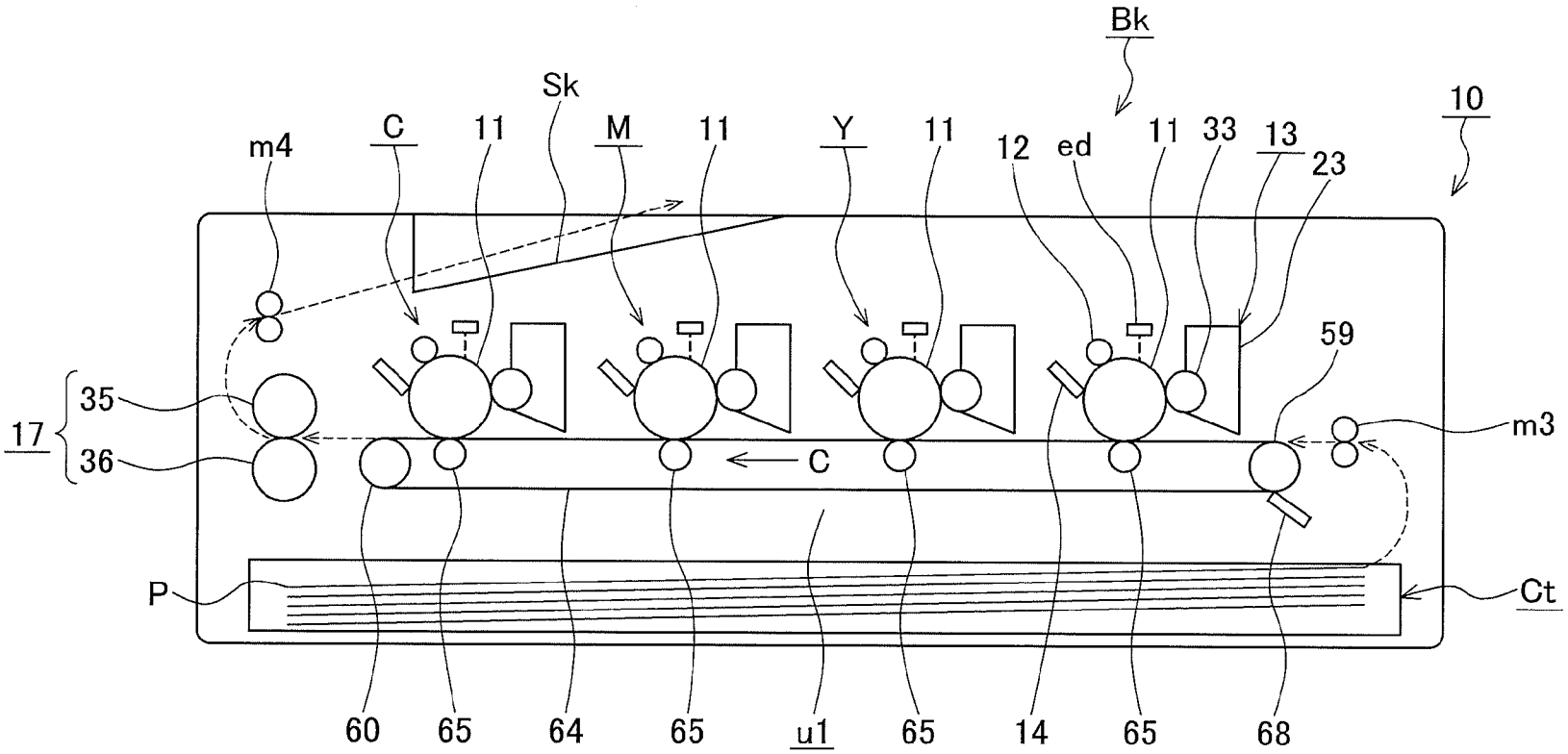
FIG. 10 is a schematic view of a printer in a second embodiment.

FIG. 10 is a schematic view showing a printer 10 in the second embodiment. The printer 10 in the second embodiment is configured to transfer toner images formed on the photosensitive drums 11 of the image forming units Bk, Y, M, and C onto a sheet P.

In FIG. 10, the printer 10 includes the transfer unit u1 disposed below the image forming units Bk, Y, M, and C.

The transfer unit u1 includes a drive roller 59 as a first roller, a driven roller 60 as a second roller, an endless belt 64 as a transfer medium, transfer rollers 65 as transfer members, a cleaning blade 68 as a second cleaning member, and other components. The drive roller 59 is disposed below and near the image forming unit Bk, connected to the belt drive motor 82 as a drive unit for driving the belt 64. The driven roller 60 is disposed below and near the image forming unit C. The belt 64 is stretched around the drive roller 59 and driven roller 60, and is driven to run in the direction indicated by arrow C in FIG. 10. Each of the transfer rollers 65 is disposed to face the corresponding photosensitive drum 11 with the belt 64 therebetween. The cleaning blade 68 is disposed in contact with the belt 64 to face the drive roller 59 with the belt 64 therebetween.

The respective photosensitive drums 11, belt 64, and respective transfer rollers 65 form transfer portions. As the belt 64 runs, toner images of the respective colors formed on the respective photosensitive drums 11 are transferred onto a sheet P fed from the sheet cassette Ct in a superposed manner in the transfer portions, so that a color toner image is formed.

The printer 10 further includes a pair of conveying rollers m3 that is connected to the conveying motor 83 and conveys a sheet P fed from the sheet cassette Ct, and a pair of conveying rollers m4 that is connected to the conveying motor 83 and conveys a sheet P discharged from the fixing unit 17.

The operation of the printer 10 will now be described.

In each of the image forming units Bk, Y, M, and C, the surface of the photosensitive drum 11 is uniformly charged by the charging roller 12. Then, the respective LED heads ed are supplied with image data of the respective colors and driven to illuminate the photosensitive drums 11, so that electrostatic latent images corresponding to the image data of the respective colors are formed on the surfaces of the respective photosensitive drums 11. Then, in the respective image forming units Bk, Y, M, and C, the toners of the respective colors are applied to the electrostatic latent images by the developing units 13, so that toner images of the respective colors are formed.

Meanwhile, a sheet P is taken from the sheet cassette Ct, conveyed by the pair of conveying rollers m3, and fed to the transfer unit u1.

In the transfer unit u1, the belt 64 is driven by the drive roller 59 and conveys the fed sheet P in the direction of arrow C. As the sheet P is conveyed on the belt 64, the toner images of the respective colors are sequentially transferred onto the sheet P in a superposed manner by the respective transfer rollers 65, so that a color toner image is formed on the sheet P.

Then, the sheet P is conveyed to the fixing unit 17, in which the color toner image is fixed to the sheet P, so that a color image is formed on the sheet P. Then, the sheet P is discharged outside the apparatus main body and is stacked on the stacker Sk.

The transfer unit u1 will now be described.

Figure 11:
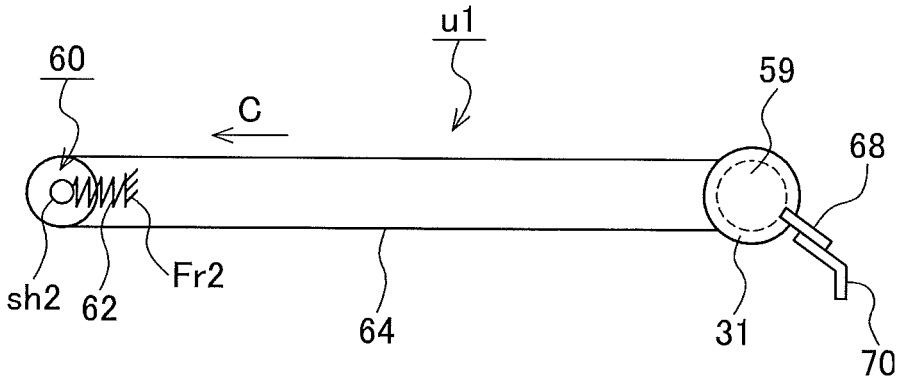
FIG. 11 shows a transfer unit in the second embodiment.

FIG. 11 shows the transfer unit in the second embodiment.

In FIG. 11, the transfer unit u1 includes the flanges 31 as the restriction members (or guide members), drive roller 59, driven roller 60, belt 64, cleaning blade 68, and a support member 70 that supports the cleaning blade 68. The driven roller 60 is provided with a spring 62 as a tension applying unit or a stretching device that applies tension to the belt 64. The spring 62 is disposed between a support member Fr2 provided in the apparatus main body and a shaft sh2 of the driven roller 60, and urges the driven roller 60 in a direction away from the drive roller 59 with a predetermined stretching force.

In this embodiment, the belt 64 is configured to satisfy, with respect to each of the two rollers (the drive roller 59 and driven roller 60) in contact with the inner surface of the belt 64, the following conditions: the maximum dynamic friction coefficient μkmax is 0.73 or less and 0.10 or more, and the amplitude Δμk is 0.51 or less (preferably 0.45 or less). This makes it possible to reduce the occurrence of abnormal sound due to running of the belt 64.

The belt 64 is configured to satisfy, with respect to each of the two rollers, the following conditions: the maximum dynamic friction coefficient μkmax is 0.73 or less and 0.12 or more, and the amplitude Δμk is 0.51 or less (preferably 0.45 or less) when the speed of the belt 64 is 0.2 mm/s. In addition or alternatively, the belt 64 is configured to satisfy, with respect to each of the two rollers, the following conditions: the maximum dynamic friction coefficient μkmax is 0.54 or less and 0.10 or more, and the amplitude Δμk is 0.23 or less (preferably 0.22 or less) when the speed of the belt 64 is 3.54 mm/s. This makes it possible to reduce the occurrence of abnormal sound due to running of the belt 64.

Although the flanges 31 are provided on the drive roller 59, such flanges may be provided on the driven roller 60 or on both the drive roller 59 and the driven roller 60. Further, although the flanges 31 are provided at the both ends of the drive roller 59, such flanges may be provided at only one end of the drive roller 59.

Although each of the first and second embodiments illustrates the printer 10 as an image forming apparatus, the present invention is applicable to other types of image forming apparatus such as a copier, a facsimile machine, a multifunction peripheral.

Although the first and second embodiments illustrate the transfer belts 24 and 64, the present invention is applicable to other types of endless belts such as a photosensitive belt, a fixing belt, or a conveying belt.

Further, each of the first and second embodiments illustrates a case where the belt satisfies the conditions with respect to each of the rollers in contact with the belt. However, the belt may satisfy the conditions with respect to each of at least one of the rollers in contact with the belt. With this configuration, for the at least one roller, the occurrence of abnormal sound can be reduced.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

a plurality of rollers including a first roller rotated by receiving rotation from a drive unit, and a second roller rotated with the rotation of the first roller;

a belt stretched around the plurality of rollers, the belt having an inner surface; and a tension applying unit that applies tension to the belt, wherein the inner surface of the belt has an uneven shape, wherein each respective roller of at least one roller of the plurality of rollers satisfies conditions expressed by $\mu kmax \leq 0.73$ and $\Delta\mu k = (\mu kmax - \mu kmin) \leq 0.51$, where $\mu kmax$ is a maximum dynamic friction coefficient between the inner surface of the belt and the respective roller, and $\mu kmin$ is a minimum dynamic friction coefficient between the inner surface of the belt and the respective roller, and wherein each respective roller of the at least one roller satisfies said conditions when a speed of the belt relative to the respective roller is 0.2 mm/s.

2. The image forming apparatus of claim 1, wherein each respective roller of the at least one roller further satisfies $\mu kmax \geq 0.12$ when a speed of the belt relative to the respective roller is 0.2 mm/s.

3. The image forming apparatus of claim 1, wherein the tension applying unit urges the second roller to apply the tension to the belt.

4. The image forming apparatus of claim 1, wherein the plurality of rollers further include a third roller rotated with the rotation of the first roller.

5. The image forming apparatus of claim 4, wherein the tension applying unit urges the third roller to apply the tension to the belt.

6. The image forming apparatus of claim 1, further comprising at least one restriction member that is disposed at at least one end of a predetermined one of the plurality of rollers and abuts against the belt to restrict movement of the belt.

7. The image forming apparatus of claim 6, wherein the predetermined roller is provided with an inclination mechanism that inclines the predetermined roller.

8. The image forming apparatus of claim 1, wherein the belt has a single layer structure.

9. The image forming apparatus of claim 1, wherein each respective roller of the at least one roller satisfies $\Delta\mu k \leq 0.45$ when a speed of the belt relative to the respective roller is 0.2 mm/s.

10. The image forming apparatus of claim 1, wherein the tension applying unit urges the second roller with a stretching force of 2 kg±0.2 kg or more and 8 kg±0.8 kg or less.

11. The image forming apparatus of claim 1, wherein a surface of the belt has a specularity of 60 or more and 200 or less.

12. The image forming apparatus of claim 1, wherein a surface of the belt has, with respect to stainless steel, a static friction coefficient $\mu e$ of 0.1 or more and 1.0 or less.

13. An image forming apparatus comprising:

a plurality of rollers including a first roller rotated by receiving rotation from a drive unit, and a second roller rotated with the rotation of the first roller;

a belt stretched around the plurality of rollers, the belt having an inner surface; and a tension applying unit that applies tension to the belt, wherein the inner surface of the belt has an uneven shape, wherein each respective roller of at least one roller of the plurality of rollers satisfies conditions expressed by $\mu kmax \leq 0.54$ and $\Delta\mu k = (\mu kmax - \mu kmin) \leq 0.23$, where $\mu kmax$ is a maximum dynamic friction coefficient between the inner surface of the belt and the respective roller, and $\mu kmin$ is a minimum dynamic friction coefficient between the inner surface of the belt and the respective roller, and wherein each respective roller of the at least one roller satisfies said conditions when a speed of the belt relative to the respective roller is 3.54 mm/s.

14. The image forming apparatus of claim 13, wherein each respective roller of the at least one roller further satisfies $\mu kmax \geq 0.10$ when a speed of the belt relative to the respective roller is 3.54 mm/s.

15. The image forming apparatus of claim 13, wherein the tension applying unit urges the second roller to apply the tension to the belt.

16. The image forming apparatus of claim 13, wherein the plurality of rollers further include a third roller rotated with the rotation of the first roller.

17. The image forming apparatus of claim 16, wherein the tension applying unit urges the third roller to apply the tension to the belt.

18. The image forming apparatus of claim 13, further comprising at least one restriction member that is disposed at at least one end of a predetermined one of the plurality of rollers and abuts against the belt to restrict movement of the belt.

19. The image forming apparatus of claim 18, wherein the predetermined roller is provided with an inclination mechanism that inclines the predetermined roller.

20. The image forming apparatus of claim 13, wherein the belt has a single layer structure.

21. The image forming apparatus of claim 13, wherein each respective roller of the at least one roller satisfies $\Delta\mu k \leq 0.22$ when a speed of the belt relative to the respective roller is 3.54 mm/s.

22. The image forming apparatus of claim 13, wherein the tension applying unit urges the second roller with a stretching force of 2 kg±0.2 kg or more and 8 kg±0.8 kg or less.

23. The image forming apparatus of claim 13, wherein a surface of the belt has a specularity of 60 or more and 200 or less.

24. The image forming apparatus of claim 13, wherein a surface of the belt has, with respect to stainless steel, a static friction coefficient $\mu e$ of 0.1 or more and 1.0 or less.

* * * * *